US006955270B2

(12) United States Patent
Lay et al.

(10) Patent No.: US 6,955,270 B2
(45) Date of Patent: Oct. 18, 2005

(54) SADDLE RACK

(75) Inventors: Kevin Lay, Lakeville, MN (US); John Huseby, Ada, MI (US); Harley Luyk, Grand Rapids, MI (US)

(73) Assignee: Saddle Boss, L.L.C., Lakeville, MN (US)

( * ) Notice: Subject to any disclaimer, the term of this patent is extended or adjusted under 35 U.S.C. 154(b) by 0 days.

(21) Appl. No.: 10/393,005

(22) Filed: Mar. 20, 2003

(65) Prior Publication Data

US 2004/0182803 A1 Sep. 23, 2004

(51) Int. Cl.[7] ..... A47F 7/00
(52) U.S. Cl. ..... 211/85.11
(58) Field of Search ..... 248/125.7, 125.2, 248/176.1, 419, 424, 142.1, 124.1; 211/85.11, 13.1, 85.7, 87.01, 94.01, 107, 193, 105, 105.3, 123

(56) References Cited

U.S. PATENT DOCUMENTS

| | | | | | |
|---|---|---|---|---|---|
| 2,760,746 | A | * | 8/1956 | Botolfsen | 248/222.51 |
| 2,809,755 | A | * | 10/1957 | Martorello | 211/85.11 |
| 3,294,267 | A | * | 12/1966 | Schweigert | 414/462 |
| 3,476,255 | A | * | 11/1969 | Ciancio | 211/85.11 |
| 3,662,909 | A | * | 5/1972 | Cherry | 414/522 |
| 3,688,912 | A | * | 9/1972 | Wilmoth | 211/85.11 |
| 3,780,971 | A | | 12/1973 | De Filipps | 248/309 |
| 3,811,574 | A | * | 5/1974 | O'Brien | 211/85.11 |
| 4,541,535 | A | | 9/1985 | Bartholomew | 211/96 |
| 4,768,656 | A | | 9/1988 | Hartley | 211/13 |
| 5,101,985 | A | | 4/1992 | Pasban-Dowlatshahi | 211/13 |
| 5,165,553 | A | | 11/1992 | Benson | 211/13 |
| 5,259,521 | A | | 11/1993 | Shaffer et al. | 211/199 |
| D343,031 | S | | 1/1994 | McElhaney | 119/96 |
| 5,361,929 | A | * | 11/1994 | McLain et al. | 220/562 |
| 5,362,078 | A | | 11/1994 | Paton | 280/47.18 |
| 5,615,783 | A | | 4/1997 | Warnken | 211/118 |
| 5,791,668 | A | | 8/1998 | Lenardson | 280/47.33 |
| 6,129,320 | A | * | 10/2000 | Warren-Pfaeffle | 248/124.1 |
| 6,206,207 | B1 | | 3/2001 | Kelley | 211/85.11 |
| 2002/0130097 | A1 | | 9/2002 | Steen et al. | 211/85.11 |
| 2003/0001348 | A1 | | 1/2003 | Weida | 280/47.19 |

* cited by examiner

*Primary Examiner*—Sarah Purol
(74) *Attorney, Agent, or Firm*—Philip F. Fox

(57) ABSTRACT

A saddle rack assembly has a slide mechanism mounted to a support structure and capable of horizontal movement between an extended position and a retracted position. The slide mechanism has a cantilevered rail mounted to the support structure and a sleeve that rides on the support structure. A saddle rack is mounted to the sleeve to provide a contoured support for the saddle. A latch mechanism is attached to the sleeve to selectively secure the sleeve in either the extended position and the retracted position.

7 Claims, 10 Drawing Sheets

SADDLE RACK

CROSS-REFERENCE TO RELATED APPLICATION(S)

None

BACKGROUND OF THE INVENTION

The present invention relates to a saddle support for holding and supporting saddles for horses when the saddles are not being used. More specifically, the present invention relates to a free-standing or mounted saddle rack with an adjustable slide mechanism to facilitate loading and unloading of the saddle.

Generally, saddles provide support and padding for a rider. In addition to supporting a rider, the saddle protects the back of a horse and assists the rider in maintaining his or her balance and shifting his or her weight as required.

The saddle tree forms the foundation of every saddle. Early trees were typically made from beech wood and reinforced with steel. Today, saddle trees are typically formed from wood, metal or molded plastic or fiberglass. The saddle tree forms the foundation for the seat and helps to distribute a rider's weight over the back of the horse. Typically, the construction of the saddle tree includes two shaped bars positioned on either side of the backbone of the horse and connected laterally by arches. The forward-most arch forms the pommel or front of the seat, and most rearward arch forms the cantle or back of the seat.

Generally, the saddle tree is covered by leather on the upper side and by sheepskin or a synthetic equivalent in areas that contact the horse. Saddles typically include well padded panels positioned under the saddle tree to act as cushions for the back of the horse. Normally, the panels are divided by a channel or gullet above the backbone of the horse to insure that the weight of the saddle and the rider is distributed over the horse's muscles on either side of the horse's spine. Sometimes, these panels are customized to fit a particular horse.

These panels require periodic care and maintenance to keep them smooth and to maintain their shape. While the saddle trees, particularly those formed of metal, fiberglass and plastic are very durable, the leather and padding can be damaged by improper storage. In addition to damage from the elements, improper storage can shift and distort the panels and scar or crease the leather. Such damage can cause pain for the horse. Depending on the severity of the pain, the horse's behavior may be affected.

Thus, it is important to keep the covering over the padding smooth and free from bumps, creases, scars or hollows so that the covering does not rub or scratch the horse. Additionally, it is important to maintain the shape and position of the padding because the saddle fit can be adversely affected by displacement or shifting of the padding.

It is known in the art that storing a saddle on the ground could damage the saddle. For this reason, saddles were often placed over the railing of the corral for temporary storage, and stored for longer periods on saddle racks when not in use. Saddle racks can be used in a wide variety of locations, such as a tack room in a trailer, a barn, a house, or any other locations. Saddle racks have been added to hand carts to facilitate carrying and portable storage of the saddles, and light weight sawhorse-like structures have been used to store saddles. However, prior art structures that are easily loaded with the saddle typically take up too much space, and devices designed to be out of the way are typically not easy to load.

It is desirable to have a saddle rack that can be loaded and unloaded easily. It is desirable to have a saddle rack assembly that can be either mounted permanently or temporarily above the ground on either a wall mount or free-standing system. It is desirable to have a saddle rack assembly that can be adapted to hold one or more saddles. Further, it is desirable to have a saddle rack that is affordable, durable, and easy to install either permanently or temporarily. Finally, it is desirable to have a saddle rack that is easy to adapt to fit in different locations while still being easy to load and easy to adjust.

BRIEF SUMMARY OF THE INVENTION

A saddle rack assembly has a slide mechanism mounted to a support structure and a saddle rack mounted to the slide mechanism and having contours corresponding to the bottom of a saddle. The slide mechanism has a horizontal rail with notches along a bottom surface and a sleeve for sliding on the rail between a retracted position and an extended position. The saddle rack is mounted to the sleeve to provide a contoured support for the saddle. A latch mechanism is attached to the bottom of the sleeve to selectively secure the sleeve in the extended position, the retracted position, or intermediate positions by engaging the notches along the bottom surface of the rail.

DETAILED DESCRIPTION

Figure 1:
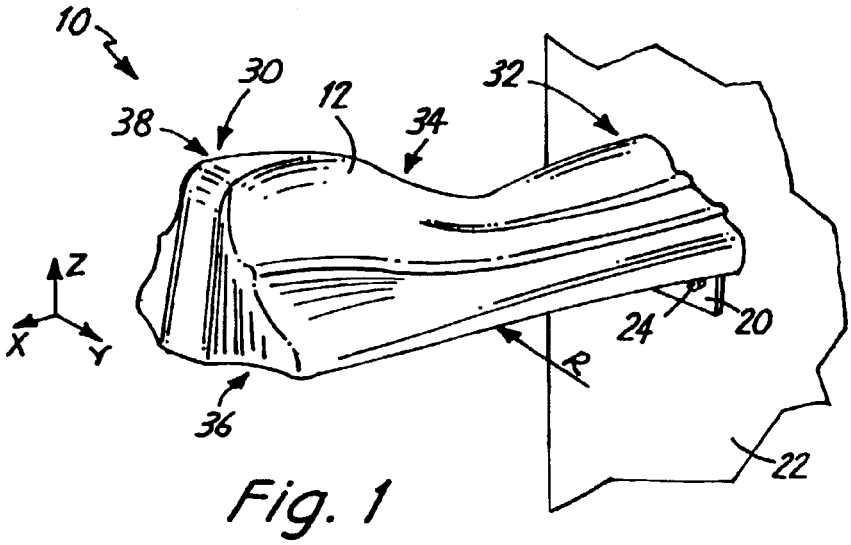
FIG. 1 is a perspective view of a permanently mounted saddle rack assembly according to the present invention.
Figure 2:
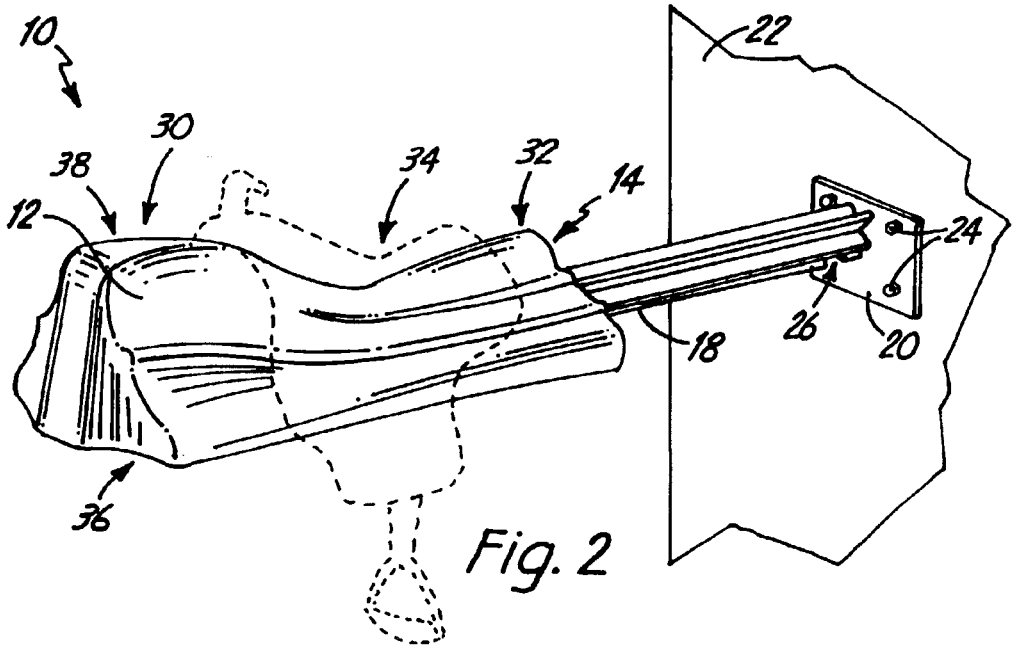
FIG. 2 is a perspective view of the saddle rack assembly of FIG. 1 in an extended position.

FIGS. 1 and 2 generally illustrate the saddle rack assembly 10 of the present invention. A saddle rack 12 having a shape that corresponds to the shape of the back of a horse is mounted to a slide mechanism 14 (shown in detail in FIGS. 3 and 4). The slide mechanism 14 generally includes a sleeve 16 (shown in FIGS. 3 and 4) that slides on a horizontal rail 18, which is attached by a flange 20 to a support structure 22.

Figure 3:
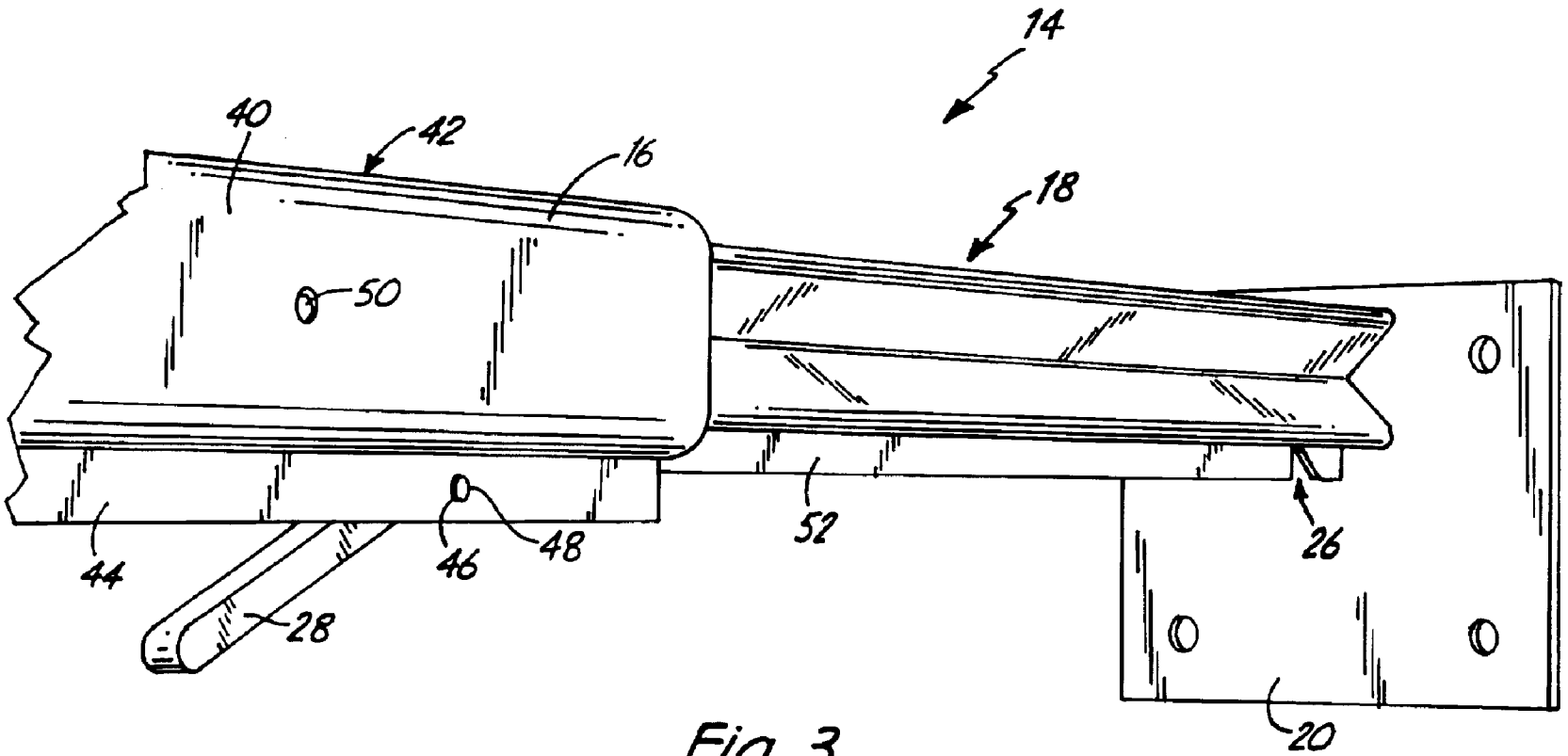
FIG. 3 is a perspective view of the extension mechanism in an extended position.
Figure 4:
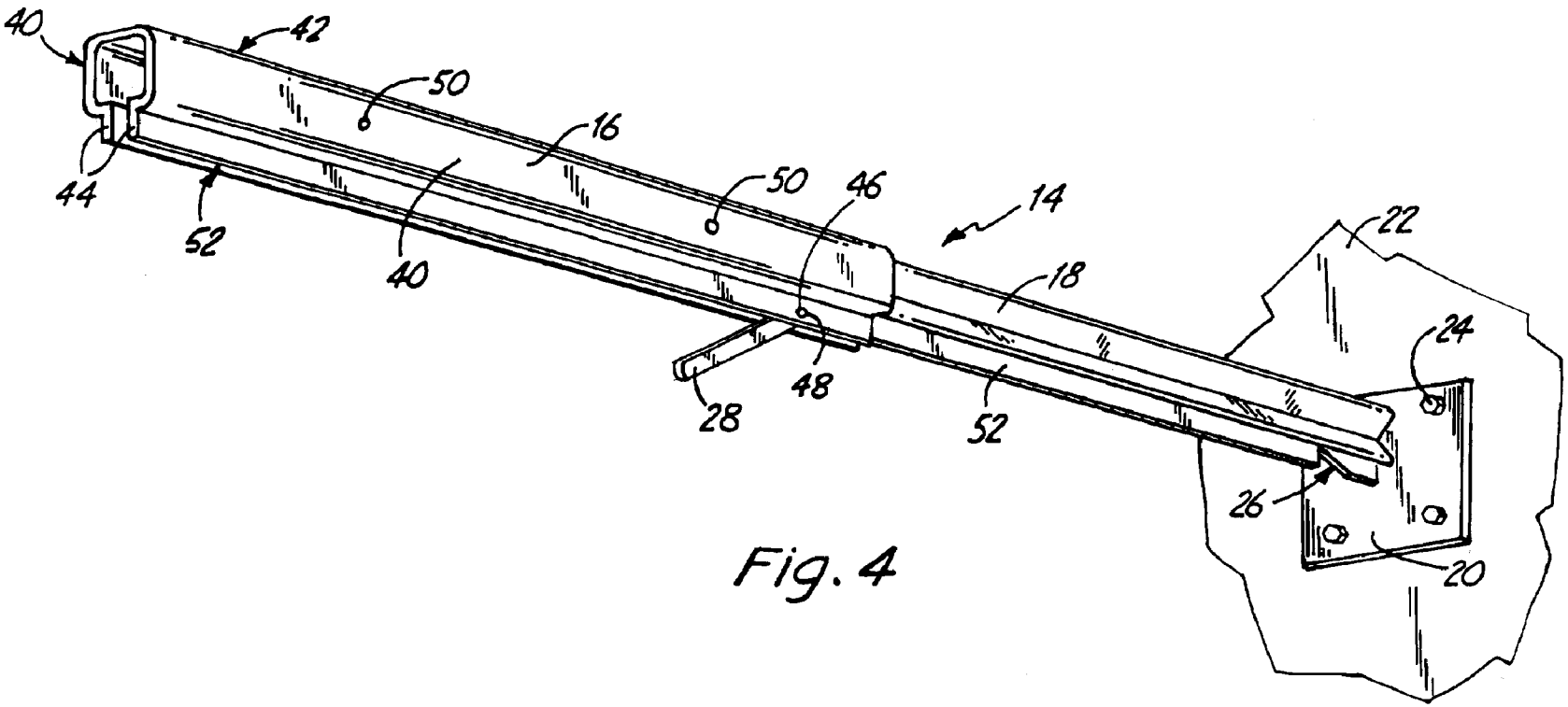
FIG. 4 is a perspective view of the extension mechanism in an extended position.

Finally, the rail 18 includes one or more notches 26 for engaging with a latch mechanism 28 (shown in FIGS. 3 and 4).

Figure 10:
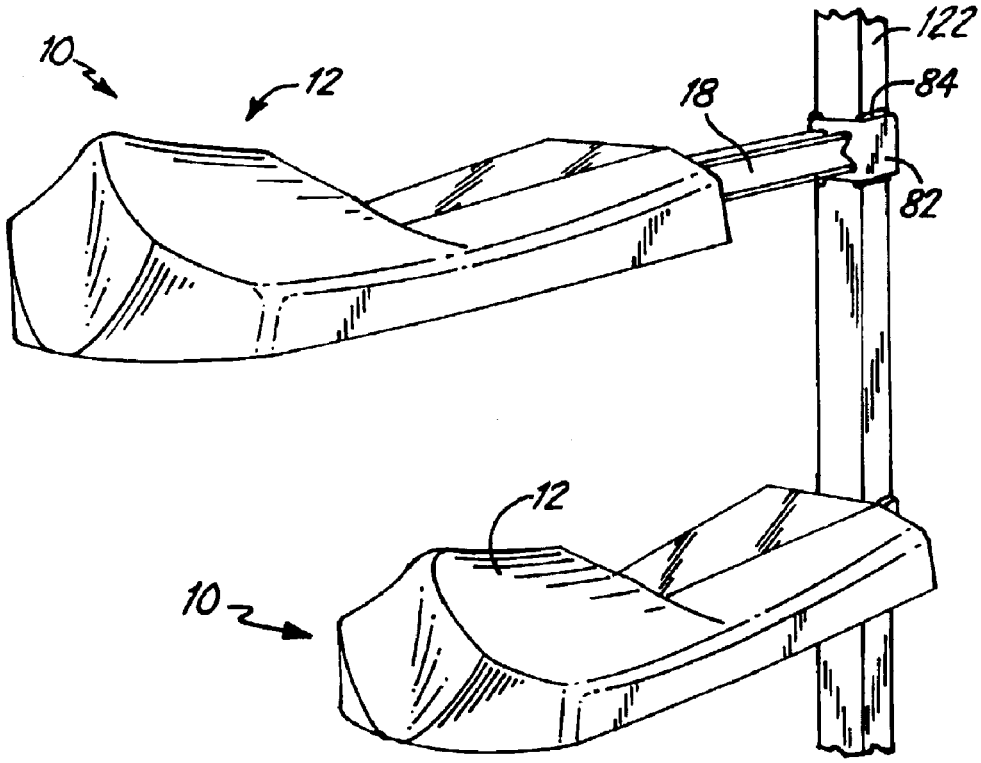
FIG. 10 is a perspective view of a stacked saddle rack assembly mounted to a post.
Figure 11:
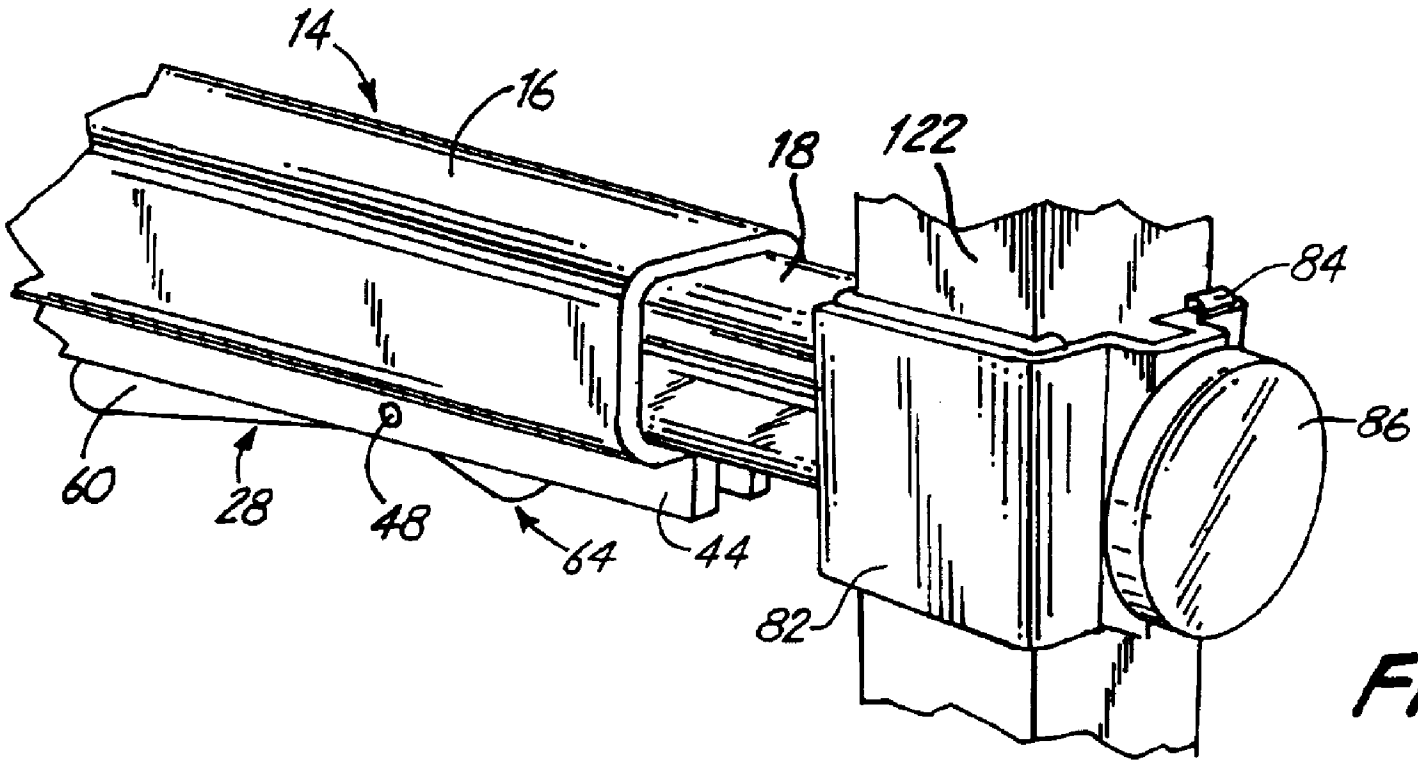
FIG. 11 is perspective view of the mount sleeve of the extension mechanism.
Figure 12:
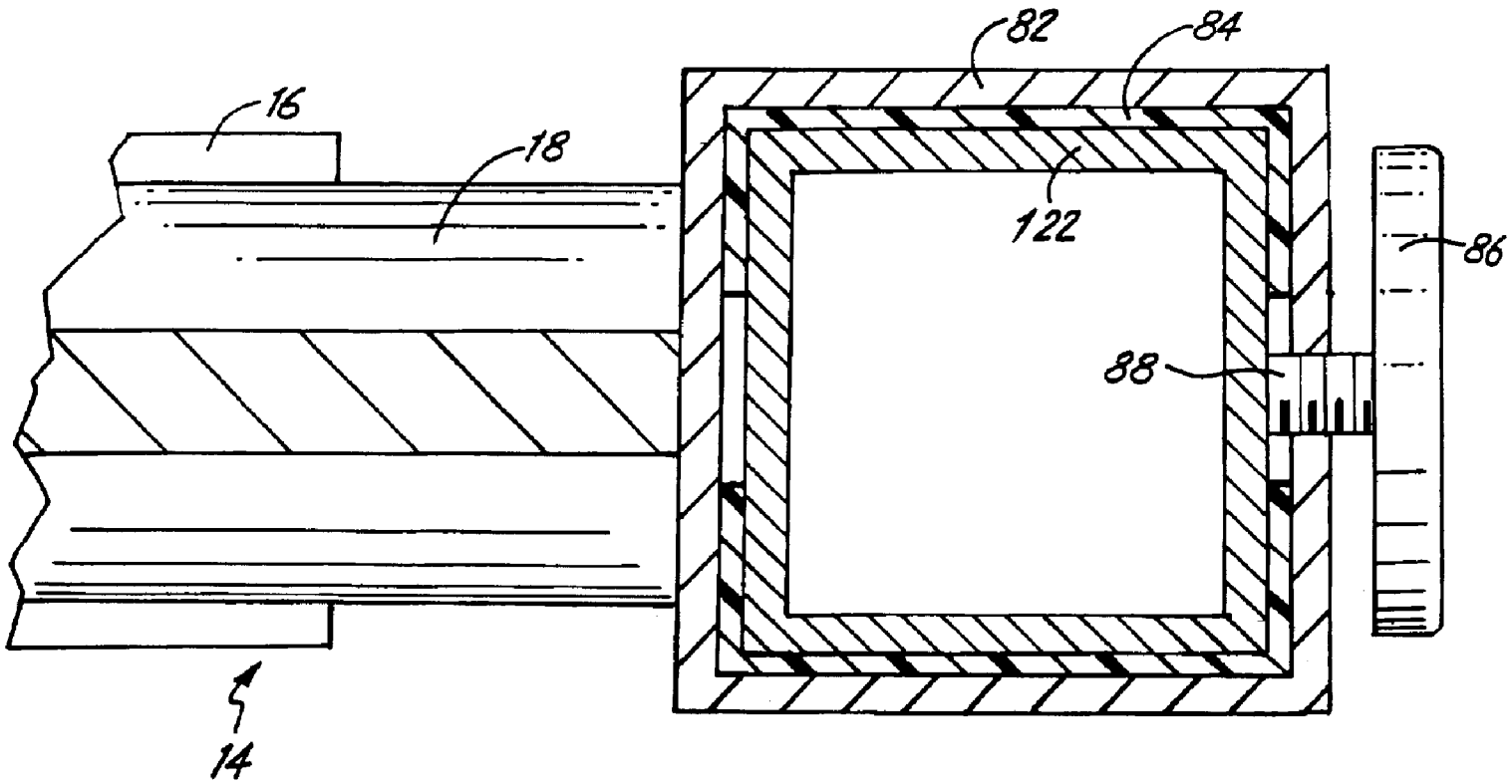
FIG. 12 is a cross sectional view of the mount sleeve of the extension mechanism taken perpendicular to the post.

In the embodiment depicted in FIGS. 1 and 2, the saddle rack assembly 10 is mounted to the support structure 22 by bolts 24, and the support structure 22 is a wall; however, the assembly 10 could be attached using rivets, nails, or other attachment means or any known technique, including welding, bonding, or other similar attachments. Additionally, the saddle rack assembly 10 could be free standing as shown in FIGS. 10–12. Specifically, the support structure 22 could also be a post such as within a horse trailer, and different, adjustable attachment mechanisms can be used to mount one or more saddle rack assemblies 10 to a single post.

In FIG. 1, the saddle rack 12 is locked in a fully retracted position. In FIG. 2, the saddle rack 12 is shown in a fully extended position. By providing a saddle rack 12 with the slide mechanism 14, the saddle rack 12 can be extended for easy loading and unloading of the saddle (shown in phantom in FIG. 2) onto the saddle rack 12. The loaded saddle rack 12 can then by retracted to the fully retracted position and locked into place using the latch mechanism 28 to store the saddle safely in a convenient place. To unload the saddle from the saddle rack 12, the latch mechanism 28 can be released, the saddle rack 12 can be pulled into a fully extended position for easy access to the saddle (as illustrated in FIG. 2).

The latch mechanism 28 attached to the slider 16 locks the saddle rack 12 into a desired position by engaging with notches 26 on the rail 18. FIGS. 1 and 2 illustrate the fully retracted position and the fully extended position, respectively. Notch 26 in the rail 18 engages with the latch mechanism 28, to hold the saddle rack 12 in the fully retracted position. A similar notch 26 illustrated in FIG. 6 engages with the latch mechanism 28 to hold the saddle rack 12 in the fully extended position. Additional notches can be added to the rail 18 to provide intermediate positions as needed. In the embodiment shown, by providing only a retracted notch and an extended notch 26, the latching mechanism 28 can be released, and the saddle rack 12 can be extended without having to hold the latching mechanism 28. In other words, the two-notch rail 18 has the advantage of smooth transition between extended and retracted positions, without requiring the user to hold the latching mechanism to bypass intermediate notches. Thus, the person's hands are free to hold onto the saddle during loading and unloading.

The saddle rack 12 itself has a contoured shape similar to a horse's back. Specifically, the rack 12 has a pommel portion 30, a cantle portion 32 and a seat portion 34. As shown, the pommel portion 30 is approximately 7.39 inches high (in the z-direction) and approximately 12.4 inches wide at the bottom 36 (in the y-direction). The pommel portion 30 narrows from the bottom 36 to the top 38. The cantle portion 32 is approximately 13.1 inches wide across the bottom 36. The saddle rack 12 is approximately 24 inches from the pommel portion 30 to the cantle portion 30 along the bottom 36 of the saddle rack 12. The saddle rack 12 includes a number of subtle curvatures including an arc defining the length of the saddle rack 12 from the pommel to the cantle portions 30,32. In this embodiment, the arc length (l) of 24 inches conforms to a radius (R) of 182 inches ($R\theta=l$, where $\theta$ is the angle defining the length of the arc along a circumference of a circle having a radius R.). Thus, on both sides of the saddle rack 12, the rack 12 curves inward toward the center of the rack 12 to model the shape of the saddle.

Other curvatures along the surface of the saddle rack 12 are visible from the figures. Such curvatures can be customized to model the back of an actual horse, such that the saddle rack 12 can be customized, and mounted to the slide mechanism 14 to adapt the assembly 10 to custom fit any saddle.

FIG. 3 illustrates the slide mechanism 14 in an expanded view without the saddle rack 12. As shown, the slide mechanism 14 includes a sleeve 16 and a rail 18. The sleeve 16 has a generally rectangular shape on the sides 40 and top 42 and guide extensions 44, which extend longitudinally along the bottom of the sleeve 16 parallel to one another. Finally, each guide extension 44 has openings 46 positioned below the bottom edge of the rail 18 and extending through both guide extensions 44 for attaching the latch mechanism 28 via a hinge 48 (such as a rivet or bolt) extending through both guide extensions 44 and through the latch mechanism 28. Finally, openings 50 on the sides 40 of the sleeve 16 are sized to receive a fastener for mounting the saddle rack 12 to the sleeve 16.

The guide extensions 44 fit a corresponding guide 52 on the bottom of the rail 18. Generally, the guide 52 along the bottom of the rail 18 has two or more notches 26 for engaging with the latch mechanism 28 to lock the saddle rack 12 into a desired position along the rail 18. The rail 18 shown in FIG. 3 has a generally five-point star configuration (in cross-section), with the point of the star pointing downward to form the guide 52. Alternatively, the rail 18 could be rectangular, triangular (in cross section) and could be sized to fit within the sleeve 16. The star-configuration of the rail 18 is a preferred embodiment, in part, because the configuration slides easily within the sleeve 16 without further adaptation. Specifically, the four points of the star-shaped rail 18 (not including the guide 52), fit within the four corners of the generally rectangular sleeve 16, thereby reducing the frictional resistance of the slide mechanism 14 to the contact points in the corners of the sleeve 16, as opposed to the entire interior surface area of the sleeve 16. While the rail 18 is shown as a star-like configuration, the rail 18 could be formed from a differently shaped beam, such as an I-beam configuration. Generally, the rail 18 can be formed in any shape and from any material provided the material is sufficiently durable and rigid enough to support bending stresses.

As illustrated in FIG. 4, guide extensions 44 extend longitudinally and parallel to one another to provide an opening 52 along the bottom 36 of the sleeve 16. The latch mechanism 28 is attached to the sleeve 16 by a hinge 48 extending through openings 46 through both guide extensions 44 and below the guide 52 of the rail 18. The sleeve 16 slides on a rail 18 with a guide 52. The guide extension 44 fits the guide 52 to assist in locking the latch mechanism 28 of the sleeve 16 during extension and retraction of the saddle rack 12.

As illustrated, the slide mechanism 14 is fixed to a flange 20 and mounted to a support structure 22 by bolts 24 through the flange 20. Generally, the rail 18 is attached to the flange 20 by any attachment means. Specifically, the rail 18 is attached to the flange 20 by welding or bonding techniques. Alternatively, the flange can be integrally formed with the rail 18. Finally, the rail 18 could be attached to the flange 20 by bolding the rail 18 onto the flange 20 though an opening (not shown). In a preferred embodiment, the rail 18 is welded to the flange 20.

Figure 5:
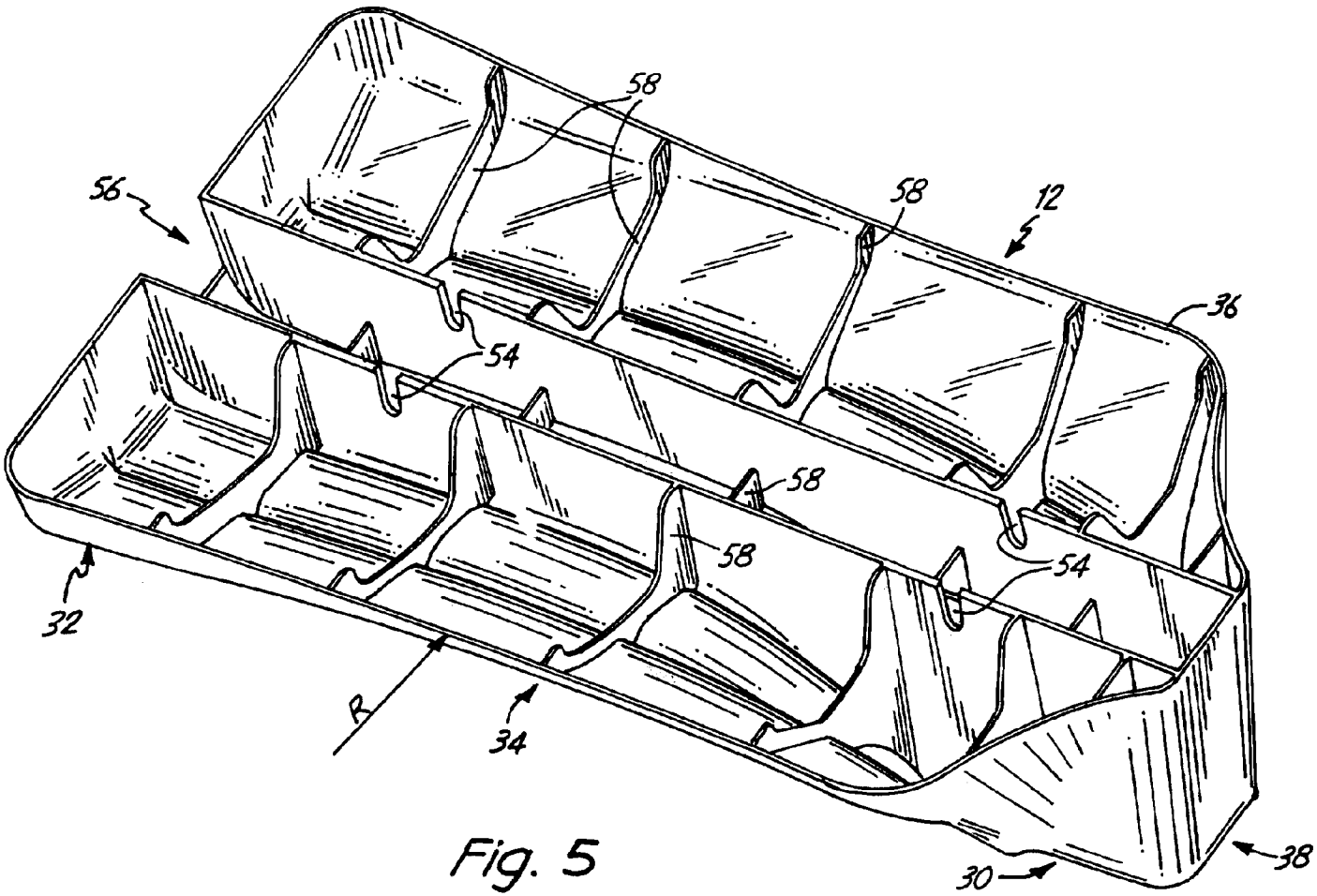
FIG. 5 is a bottom view of the saddle rack of the present invention.

FIG. 5 illustrates a bottom plan view of a saddle rack 12 of the present invention. In the present invention, the saddle rack 12 is a replaceable component that can be molded to conform precisely to the bottom of a saddle. The saddle rack 12 can be releasably mounted to the slide mechanism 14 (illustrated in FIGS. 3 and 4 above) via fasteners (illustrated in FIG. 8) extending into slots 54 and extending through openings 50 in the sleeve 16. The generally rectangular section 56 is sized to receive the sleeve 16 for mounting the saddle rack 12 to the sliding mechanism 14.

Cross braces 58 provide rigidity to the saddle rack 12 and generally support the saddle rack 12 direction on the sleeve 16. As illustrated, the base 36 of the saddle rack 12 along its sides has a curvature with a radius R as discussed above. This radius corresponds to a curvature of the bottom of a saddle at the position of a rider's legs when the saddle is placed on a horse.

Generally, the saddle rack 12 may be formed from any light-weight, durable, and relatively rigid material. For example, the saddle rack 12 can be formed from wood, metal, fiberglass, molded plastic, ceramic and any other material. In a preferred embodiment, the saddle rack 12 is formed from a molded plastic. The saddle rack 12 can be custom made to conform precisely to the bottom of a saddle or to the back of a horse. Alternatively, the saddle rack 12 can be molded according to a standard shape that conforms to the bottom of most off-the-shelf saddles. Since the saddle rack 12 is a separate element that is mounted to the sliding mechanism 14, the saddle rack 12 can be replaced with a differently shaped saddle rack 12 as needed.

Figure 6:
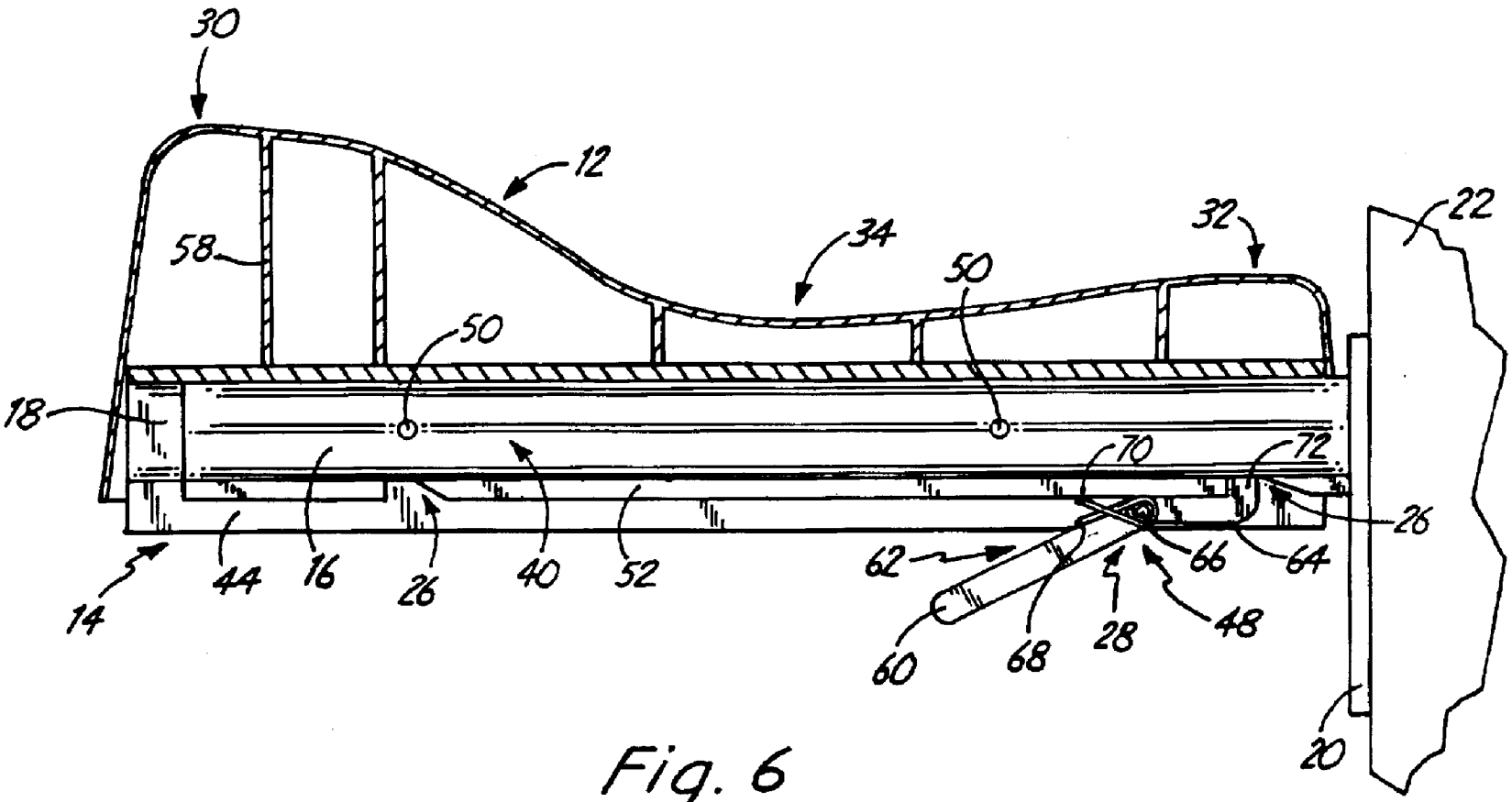
FIG. 6 is a cross-sectional view of the saddle rack mounted on the extension mechanism.

As illustrated in FIG. 6, the saddle rack 12 rests on the sleeve 16 and is bolted to the sleeve through openings 50 in the sides 40 of the sleeve 16. The sleeve 16 is then mounted on the rail 18, such that the guide extensions 44 are on either side of the guide 52. Finally, the latch mechanism 28 engages with the notch 26 to secure the saddle rack 12 in a desired position and as illustrated in the fully retracted position.

The latch mechanism 28 includes a handle potion 60, a hinge 48, a spring 62, and a latch portion 64. As illustrated, the handle portion 60 is attached to the guide extensions 44 via the hinge 48. Generally, the openings 46 in the guide extensions 44 are positioned below the guide 52 so that the hinge 48 does not interfere with the extension and retraction of the saddle rack 12. The hinge 48 extends through the opening 46 in each guide extension 44 and through an opening in the latch mechanism 28 between the handle portion 60 and the latch portion 64. The spring 62 is positioned on the latch mechanism 28 inside the guide extensions 44, and the hinge 48 extends through the spring 62.

The spring 62 has a coil 66 on either side of the latch mechanism 28 and around the hinge 48, and has a wire 68 extending over the handle portion 60 of the latch mechanism 28. The other end of the spring 62 has wire extensions 70 for interfacing with the guide extensions 44 to bias the latch mechanism 28 into a locked position. While the dimensions of the spring 62 may vary, in the embodiment illustrated, the coiled portion 66 of the spring 62 has a radius of approximately 0.115 inches. The spring 62 is formed from a wire stock having a diameter of approximately 0.039 inches. Finally, the spring is approximately 2.268 inches in length, approximately 0.543 inches wide, and has wire extensions 70 of approximately 0.87 inches for interfacing with the guide extensions 44. Finally, the latch mechanism 28 has a handle portion that extends approximately 2.828 inches, a latch portion 64 in the shape of a letter "L" having a length of approximately 1.25 inches and a base or hook portion 72 of approximately 0.657 inches. The substrate of the latch mechanism 28 can be formed from a metal, ceramic or any other rigid and durable material. In a preferred embodiment, the latch mechanism 28 is formed from the same material as the rail 18. In a preferred embodiment, the sleeve 16 is formed from fiberglass, and the rail 18 and the latch mechanism 28 are formed from aluminum.

Figure 7:
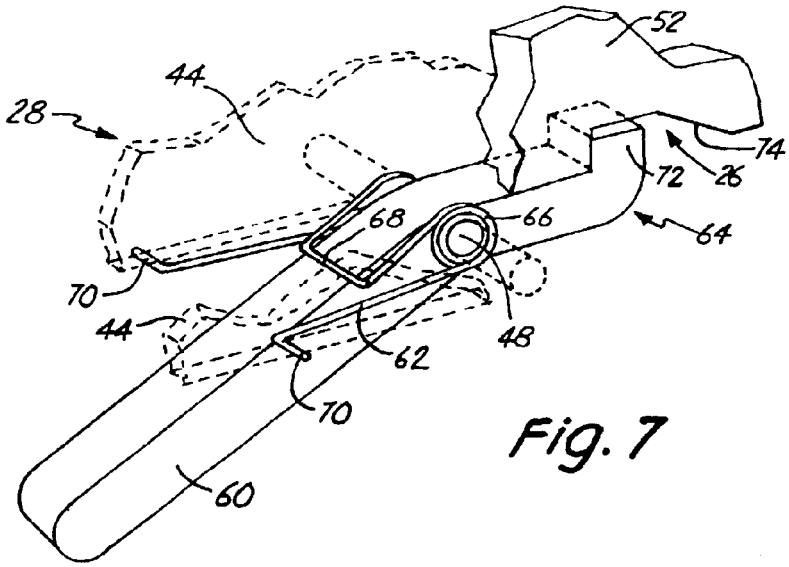
FIG. 7 is a perspective view of the latching mechanism with portions shown in broken lines for clarity.

As illustrated in FIG. 7, the hinge 62 has coils 66, a wire 68 extending over the handle portion 60 of the latch mechanism 28, and extensions 70 for interfacing with the guide extensions 44 for biasing the latch mechanism 28 into a locked position. The coils 66 are disposed around the hinge 48 on either side of the latch mechanism 28, the wire 68 extends over the handle portion 60 to connect the coils 66. Finally, the wire extensions 70 extend into the guide extensions 44 on either side of the latch mechanism 28.

As illustrated, the hook portion 72 of the latch 64 engages with the notch 26 when in a locked position. Additionally, the notch 26 has a slanted wall 74 on the side of the notch 26 closest to the support structure 22, allowing the saddle rack to be adjusted to a fully retracted position easily and without disengaging the latch mechanism 28. By contrast, to extend the sliding mechanism 14, the handle 60 of the latch mechanism 28 must be raised to disengage the latch 64 from the notch 26 prior to extending the saddle rack 12.

Figure 8:
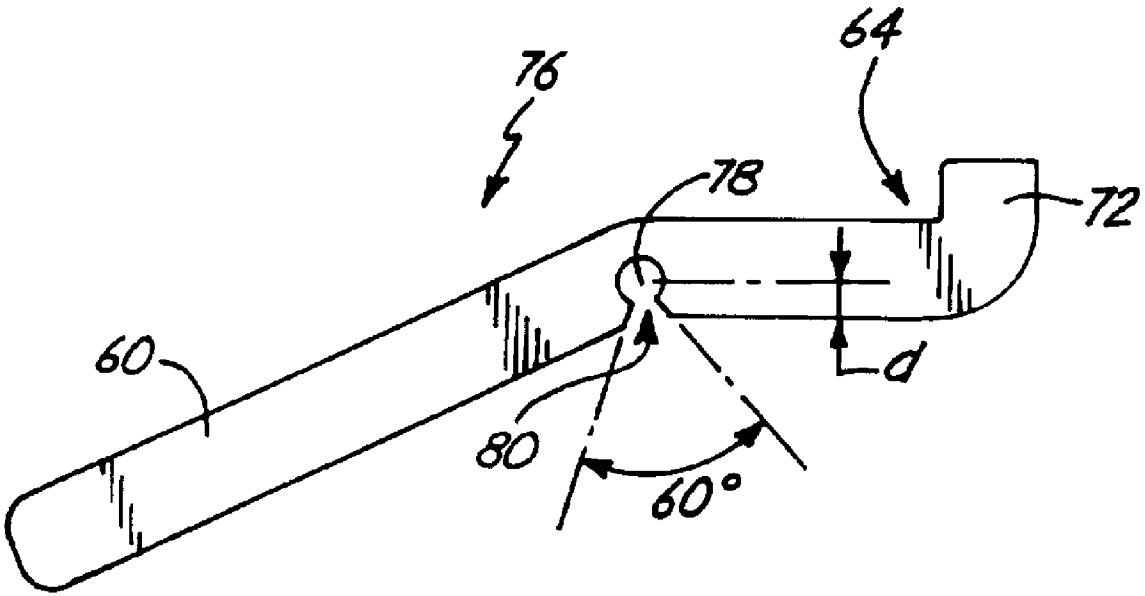
FIG. 8 is a schematic view of the substrate of the latch mechanism.

As illustrated in FIG. 8, the substrate 76 includes the handle portion 60, the latch portion 64, and a hinge interface 78 sized to receive the hinge 48. As illustrated, the hinge interface 78 is substantially circular with a pie-shaped opening 80 on the bottom side. The pie-shaped opening 80 defines an angle of approximately 60 degrees. The pie-shaped opening 80 allows for easy assembly of the hinge 48 with the hinge interface 78.

Figure 9:
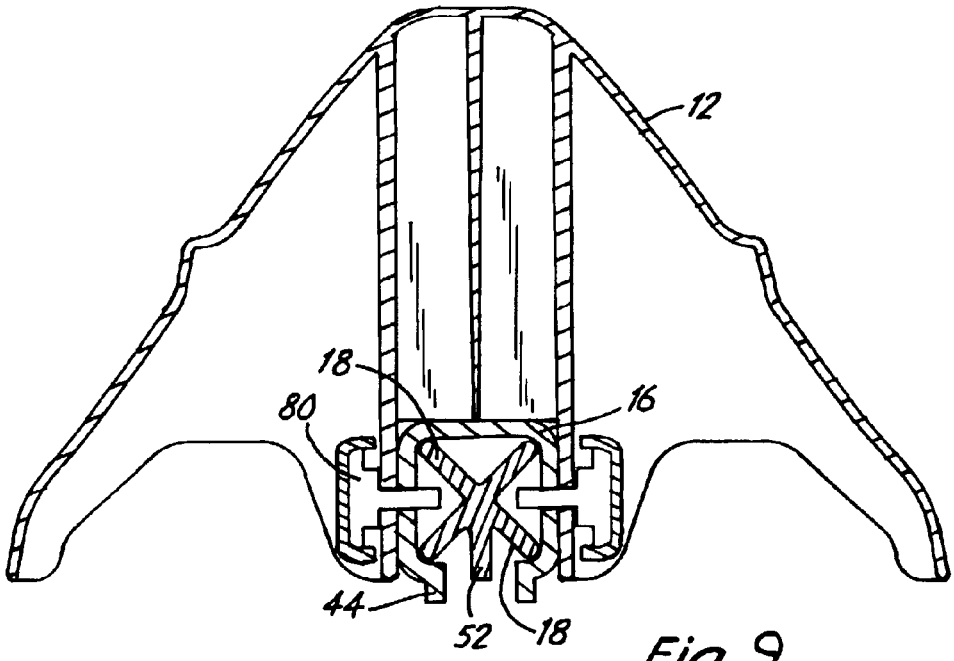
FIG. 9 is a cross-sectional view of the saddle rack and the extension mechanism taken perpendicular to the extension mechanism.

As illustrated in FIG. 9, the saddle rack 12 fits over the sleeve 16. Fasteners 80 extend through the slots 54 in the saddle rack 12 and into the openings 50 on the sleeve. The openings 50 may be threaded or the fasteners 80 may include a locking pin or other means to hold the fastener 80 in position. In a preferred embodiment, the openings 50 are threaded to receive threaded fasteners 80.

The star-shaped configuration of the rail 18 in this embodiment allows the fasteners 80 to be tightened through the openings 50 without interfering with the movement of the sleeve 16 relative to the rail 18. Alternative embodiments could be used. In particular, the fasteners 80 could be made to tighten against the outside surface of the slider 16, so that clearance of the trailing end of the fastener 80 need not be considered.

As illustrated, the star-shaped configuration of the rail 18 reduces the amount of surface area of the rail 18 in contact with the interior surface of the sleeve 16, minimizing friction between the sleeve 16 and the rail 18. Moreover, the rail 18 is lighter than a solid rail, and the points of the star-shape of the rail 18 fit within the sleeve 16 to prevent the sleeve from twisting on the rail 18.

As illustrated, the guide 52 need not contact the guide extensions 44. Moreover, the guide extensions 44 extend below the guide 52 to allow for attachment of the latch mechanism 28 without interfering with the movement of the sleeve 16.

FIG. 10 illustrates an alternative embodiment of the mounting apparatus, in particular, a free-standing post and a mounting clamp 82. In FIGS. 1, 2 and 4, the assembly 10 was mounted to a fixed support structure 22, such as a wall. However, the assembly 10 can also be mounted to a post using a clamp 82 to fix the assembly 10 to the post above the ground. Moreover, with a free-standing post 122 as illustrated, multiple saddle rack assemblies 10 can be mounted to the same post to hold multiple saddles, each with its own slide mechanism 14 for extending and retracting the saddle rack 12.

The saddle racks 12 have different curvatures from the saddle rack of FIGS. 1 and 2. As previously discussed, the saddle rack 12 is formed from fiberglass and can be made in any shape or configuration or customized to model the shape of a horse's back or the underside of the saddle. The saddle rack 12 can be changed with a differently shaped saddle rack 12 in order to fit a differently shaped saddle as needed.

In this case, the rail 18 is attached to the clamp 82 by welding or other attachment means such as a bolt or rivet through the inside of the clamp 82 and into the rail 18. The clamp 82 may be of any shape and may be sized to fit around any post or pole. As illustrated, the post 122 is generally rectangular in cross-section, and the clamp 82 is generally rectangular and sized to fit around the post 122. Additionally, a clamp sleeve 84 is positioned between the clamp 82 and the post 122 to assist in adjustment of the position of the clamp and to perfect the attachment between the clamp 82 and the post 122 when in use.

FIG. 11 illustrates the post-mounted assembly 10 from the direction of the supporting structure 122. As illustrated, the clamp 82 fits over a clamp sleeve 84 and around the post 122. The clamp 82 is then tightened against the post 122 using the handle 86, which is connected to a fastener, which extends through the clamp 82. In a preferred embodiment, the fastener secures the clamp 82 against the post 122 by tightening against an outside surface of the post 122, thereby holding the assembly 10, at a position above the ground via pressure. Alternate clamping mechanisms are also possible, such as providing a post 122 with openings for receiving the fastener, and providing a releasable fastener that extends through the clamp 82 and through the post 122.

The clamp 82 of the present invention allows the user to adjust the height of the saddle rack assembly 10 relative to the ground. In the case of a single saddle rack 12, the height of the assembly 10 could be adjusted to make it easier for the user to load and unload the saddle. In the case of multiple saddle racks, the height of each saddle rack assembly 10 can be adjusted to allow for room between saddles and to maximize the access to the assemblies 10. Since each assembly 10 can be extended or retracted independent of the others, the assembly 10 can be extended as needed to assist in loading and unloading the saddle.

As illustrated in FIG. 12, the clamp 82 is attached to the rail 18 by welding. The clamp 82 is placed over the clamp sleeve 84 and over the post 122. Then, the vertical position of the assembly 10 is adjusted to the desired height before turning the handle 86 to tighten the fastener through the clamp 82 and against the post.

As discussed in detail above, the assembly of FIGS. 10–12 is generally the same as the assembly of FIGS. 1–9, except that the mounting structure is the post 122, which necessitates the clamp 82 as opposed to the flange 20 of FIGS. 1–9. The post 122 may be permanently attached as a support post by bolting, nailing or otherwise fixing the ends of the post to the floor and ceiling. In an alternative embodiment, the post 122 may be a telescoping metal post with an internal spring, which allows the post 122 to be moved and remounted to a structure via pressure. Specifically, in this instance, the spring would exert pressure on the telescoping ends of the post 122 to secure the post vertically via pressure between the floor and the ceiling.

Although the present invention has been described with reference to preferred embodiments, workers skilled in the art will recognize that changes may be made in form and detail without departing from the spirit and scope of the invention.

What is claimed is:

1. A saddle rack assembly comprising:

a vertically-oriented support structure comprising a post a slide mechanism, the slide mechanism comprising a clamp on end of the slide mechanism, the clamp adjustably mounted on the post the slide mechanism capable of horizontal movement between an extended position and a retracted position, each position defined by a respective stop on the slide mechanism, and a height of the slide mechanism vertically adjustable relative to a horizontal reference; and a saddle rack having surface contours corresponding to a bottom of a saddle and wherein said saddle rack is further on the slide mechanism.

2. The saddle rack assembly of claim 1 wherein the slide mechanism comprises:

a horizontal rail; and a sleeve positioned on the rail for mounting of the saddle rack.

3. The saddle rack assembly of claim 1, and further comprising:

a latching mechanism for selectively securing the saddle rack in either the extended position or the retracted position.

4. The saddle rack assembly of claim 1 wherein the clamp is vertically moveable to adjust the height of the slide mechanism relative to the horizontal reference.

5. The saddle rack assembly of claim 4 wherein the horizontal reference is a floor, a ceiling, or a second slide mechanism.

6. The saddle rack assembly of claim 1 wherein the post is a telescoping post.

7. The saddle rack assembly of claim 1 wherein the slide mechanism includes a rail and a sleeve mounted on the rail, and further comprising:

notches along a bottom surface of the rail, the notches defining the stops; and a latching mechanism for engaging the notches to secure the saddle rack in either the extended position, the retracted position, or one or more intermediate positions.

* * * * *